US009045250B2

(12) United States Patent
Henderson et al.

(10) Patent No.: US 9,045,250 B2
(45) Date of Patent: Jun. 2, 2015

(54) ONE PIECE BULK BIN HAVING AN AUTOMATICALLY-ERECTING BOTTOM AND METHODS FOR CONSTRUCTING THE SAME

(75) Inventors: Jesse William Henderson, Rogers, AR (US); Kevin Len Henry, Rogers, AR (US); Ronald W. Farmer, Fayetteville, AR (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 257 days.

(21) Appl. No.: 13/553,534

(22) Filed: Jul. 19, 2012

(65) Prior Publication Data

US 2014/0021246 A1 Jan. 23, 2014

(51) Int. Cl.

| | |
|---|---|
| ***B65D 5/10*** | (2006.01) |
| ***B65D 5/42*** | (2006.01) |
| ***B31B 49/02*** | (2006.01) |
| ***B65D 5/36*** | (2006.01) |
| ***B65D 65/40*** | (2006.01) |
| ***B65D 5/02*** | (2006.01) |

(52) U.S. Cl.

CPC ..... *B65D 5/3621* (2013.01); *B65D 65/403* (2013.01); *B65D 5/029* (2013.01)

(58) Field of Classification Search

USPC ..... 229/117, 108, 110, 184, 213, 214, 249; 493/121

See application file for complete search history.

(56) References Cited

U.S. PATENT DOCUMENTS

| | | | | |
|---|---|---|---|---|
| 2,917,222 | A * | 12/1959 | Frankenstein | 229/110 |
| 3,101,167 | A * | 8/1963 | Styler | 229/108.1 |
| 3,525,466 | A * | 8/1970 | Robinson | 229/117 |
| 4,549,690 | A * | 10/1985 | Rosenburg | 229/109 |
| 4,702,408 | A | 10/1987 | Powlenko | |
| 4,736,885 | A | 4/1988 | Negus, Sr. | |
| 5,573,175 | A | 11/1996 | Straub et al. | |
| 5,772,108 | A | 6/1998 | Ruggiere, Sr. et al. | |
| 6,074,331 | A | 6/2000 | Ruggiere, Sr. et al. | |
| 6,220,508 | B1 | 4/2001 | Wisser | |
| 6,588,651 | B2 | 7/2003 | Quaintance | |
| 6,783,058 | B2 | 8/2004 | Quaintance | |
| 6,932,266 | B2 | 8/2005 | Jones et al. | |
| 7,128,257 | B2 | 10/2006 | Hyatt et al. | |
| 7,328,833 | B1 | 2/2008 | Wiley | |
| 7,381,176 | B2 | 6/2008 | Graham et al. | |
| 7,434,721 | B2 | 10/2008 | Feltz | |
| 7,651,024 | B2 | 1/2010 | Barner | |
| 7,654,440 | B2 | 2/2010 | Quaintance et al. | |
| 7,681,781 | B2 | 3/2010 | Wisecarver | |
| 2006/0027638 | A1 | 2/2006 | Jones et al. | |
| 2006/0124716 | A1 | 6/2006 | Quaintance et al. | |

(Continued)

*Primary Examiner* — Christopher Demeree

(74) *Attorney, Agent, or Firm* — Armstrong Teasdale LLP

(57) ABSTRACT

A container formed from a single blank of sheet material is provided. The container includes an automatically-erecting bottom wall configured to be selectively moveable between a substantially flat position and a fully erect position. The container includes a plurality of side panels, including at least a first side panel, a second side panel, a third side panel, and a side joining tab. The container also includes a plurality of bottom flaps for forming a bottom wall, including both minor and major bottom flaps. A first bottom flap extends from the first side panel, a second bottom flap extends from the second side panel, and a third bottom flap extends from the third side panel. The second bottom flap includes a first minor joining tab for coupling to the first bottom flap. The third bottom flap includes a third joining tab for coupling to a second major bottom flap.

20 Claims, 8 Drawing Sheets

(56) References Cited

U.S. PATENT DOCUMENTS

2007/0131746 A1* 6/2007 Quaintance et al. ..... 229/109
2007/0152027 A1 7/2007 Hyatt et al.
2008/0067221 A1 3/2008 Mengistu et al.
2010/0230479 A1 9/2010 Graham et al.

* cited by examiner

ONE PIECE BULK BIN HAVING AN AUTOMATICALLY-ERECTING BOTTOM AND METHODS FOR CONSTRUCTING THE SAME

BACKGROUND OF THE INVENTION

This invention relates generally to packaging and, more particularly, to a collapsible bulk bin formed from a single blank of sheet material that includes an automatically-erecting bottom wall, and methods for forming the same collapsible bulk bin.

Containers are frequently utilized to store and aid in transporting products. These containers may be square, hexagonal, or octagonal. At least some known containers, or bulk bins, used to transport products are designed to fit a standard sized pallet. The shape of the bulk bin can provide additional strength to the container. For example, a hexagonal-shaped bulk bin provides greater resistance to bulge over conventional rectangular or square bulk bins. An empty bulk bin can be shipped in a knocked-down flat state and opened to form an assembled bulk bin that is ready for use. Shipping and storing bulk bins in a knocked-down flat state saves money and space. The size and configuration of bulk bins, however, can make (i) the initial forming of the bulk bin difficult, and (ii) the setup of the bulk bin, after it has been formed, difficult for an individual to complete.

The initial formation of known bulk bins can be difficult and problematic. At least some known bulk bins are formed from multiple blanks of sheet material. These multiple blanks of sheet material must be joined together to form the bulk bin. The joining together of multiple blanks of sheet material can be difficult, time consuming, and costly, particularly in a high speed manufacturing environment.

Setup of at least some known bulk bins often requires more than one person to erect the bulk bin because of the size and complexity of erection. A typical bulk bin may include multiple bottom flaps that must be manually manipulated and interconnected when erecting the bulk bin. Such bulk bins may be inverted during assembly to facilitate configuring the bottom flaps. The top edge of the bulk bin may become contaminated during assembly if inverted and placed on an unclean surface. Additionally, the interlocking bottom flaps may become disengaged during the erecting process while rotating the bulk bin back to an upright position. A bulk bin that is complex to erect or requires more than one person to complete assembly can cause unwanted expenses and wasted time for a user of the bulk bin.

BRIEF DESCRIPTION OF THE INVENTION

In one aspect, a container formed from a single blank of sheet material is provided. The container includes an automatically-erecting bottom wall that is configured to be selectively moveable between a substantially flat position and a fully erect position. The container includes a plurality of side panels, which includes at least a first side panel, a second side panel, a third side panel, and a side joining tab, wherein the plurality of side panels define a polygonal enclosure. The polygonal enclosure further defines a cavity. The container also includes a plurality of bottom flaps for forming an automatically-erecting bottom wall. The plurality of bottom flaps include at least a first, second, and third bottom flap, wherein each bottom flap extends from a bottom edge of a respective side panel of the plurality of side panels. The first and second bottom flaps are minor bottom flaps, and the third bottom flap is a major bottom flap. The second bottom flap includes a first minor joining tab for coupling the second bottom flap to the first bottom flap. The third bottom flap includes a major joining tab for coupling to a second major bottom flap.

In another aspect, a container formed from a single blank of sheet material is provided. The container includes an automatically-erecting bottom wall that is configured to be selectively moved between a substantially flat position and a fully erect position. The container includes a plurality of side panels coupled across fold lines. The container includes a first side panel, a second side panel, a third side panel, a fourth side panel, a fifth side panel, and a sixth side panel. The container also includes a side joining tab extending across a fold line from the sixth side panel for connecting to the first side panel. The container also includes a plurality of bottom flaps for forming an automatically-erecting bottom wall. The plurality of bottom flaps includes first, second, third, fourth, fifth, and sixth bottom flaps, each bottom flap extending from a bottom edge of a respective side panel of the plurality of side panels. The third and sixth bottom flaps are major bottom flaps, and the first, second, forth and fifth bottom flaps are minor bottom flaps. The second bottom flap includes a first minor joining tab coupled across a joint fold line. The third bottom flap includes a major joining tab coupled across a joint fold line. The fourth bottom flap includes a second minor joining tab coupled across a joint fold line. The first and second minor joining tabs are coupled to adjacent minor bottom flaps. The major joining tab is coupled to the sixth bottom flap. The bottom flaps are configured to form the automatically-erecting bottom wall when the container is moved from the substantially flat position to the fully erect position.

In another aspect, a method for constructing a container is provided. The method includes providing a single blank of sheet material that includes a plurality of side panels. The plurality of side panels includes at least a first side panel, a second side panel, a third side panel, and a side joining tab, wherein the plurality of side panels at least partially define a cavity of the container. The container also includes a plurality of bottom flaps. The plurality of bottom flaps include at least a first, second, and third bottom flap, each bottom flap extending from a bottom edge of a respective side panel of the plurality of side panels. The first and second bottom flaps are minor bottom flaps, and the third bottom flap is a major bottom flap. The second bottom flap includes a first minor joining tab extending from a first joint fold line. The third bottom flap includes a major joining tab extending from a second joint fold line. The method further includes folding the first minor joining tab about the first joint fold line such that an interior surface of the first minor joining tab is in substantially face-to-face contact with an interior surface of the second bottom flap and folding the major joining tab about the second joint fold line such that an interior surface of the major joining tab is in substantially face-to-face contact with an interior surface of the third bottom flap. Additionally, the method includes coupling the first minor joining tab to the first bottom flap and coupling the major joining tab to another major bottom flap.

BRIEF DESCRIPTION OF THE DRAWINGS

Corresponding reference characters indicate corresponding parts throughout the several views of the drawings.

DETAILED DESCRIPTION OF THE INVENTION

A collapsible bulk bin and methods of constructing a collapsible bulk bin are described herein. More specifically, a collapsible bulk bin formed from a single blank of sheet material having multiple side walls, an automatically-erecting bottom wall, and reinforcing straps is described herein, along with a method of constructing the bulk bin. It will be apparent, however, to those skilled in the art and guided by the teachings herein provided that the invention is likewise applicable to any storage container including, without limitation, a carton, a tray, a box, or a bin.

In one embodiment, the container is fabricated from a corrugated paperboard material. The container, however, may be fabricated using any suitable material, and therefore is not limited to a specific type of material. In alternative embodiments, the container is fabricated using cardboard, paperboard, plastic, or any suitable material known to those skilled in the art and guided by the teachings herein provided. The container may have any suitable size, shape, or configuration (i.e., number of sides), whether or not such sizes, shapes, or configurations are described or illustrated herein. For example, in one embodiment, the container includes a shape that provides functionality, such as a shape that facilitates transporting the container, a shape that facilitates stacking or arrangement of a plurality of containers, or a shape that resists forces directed outwardly from the contents such as bulging forces.

Figure 1:
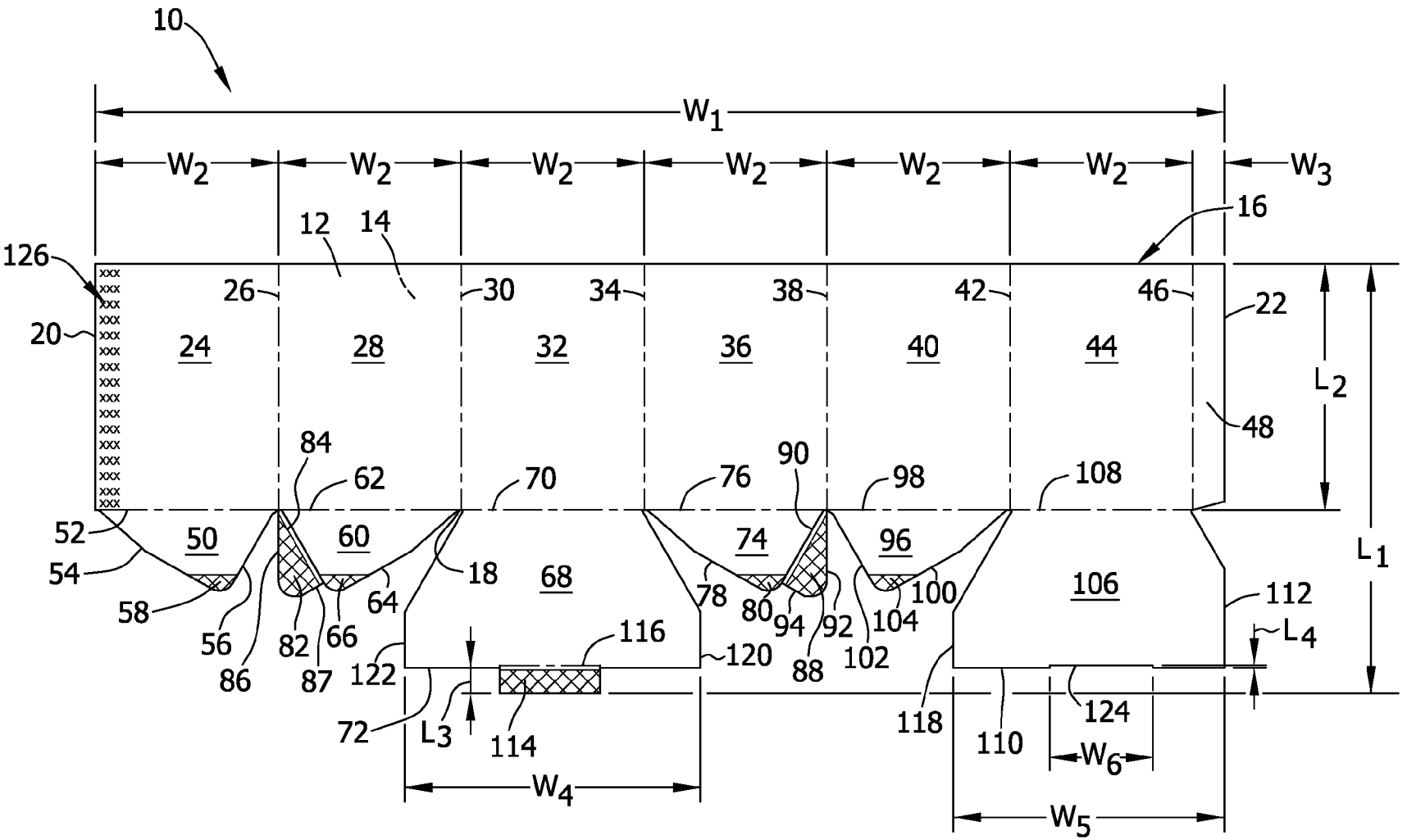
FIG. 1 is a top plan view of a blank of sheet material for forming a container according to one embodiment of this invention.

Referring now to the drawings, FIG. 1 is a top plan view of a blank of sheet material 10 for forming a container in accordance with one embodiment of the present invention. In one embodiment, blank 10 is made of corrugated paperboard, cardboard, plastic, paperboard, or any suitable material. Further, in one embodiment, blank 10 has a width W1 and a length L1. Blank 10 includes an interior surface 12 and an exterior surface 14. Blank 10 also includes a top edge 16, a bottom edge 18, a first end edge 20, and a second end edge 22. Blank 10 includes a plurality of side panels including a first side panel 24 (first end side panel), coupled across a side fold line 26, to a second side panel 28. Further, blank 10 includes a third side panel 32, coupled across a side fold line 30, to second side panel 28. Blank 10 also includes a fourth side panel 36, coupled across a side fold line 34, to third side panel 32, and a fifth side panel 40, coupled across a side fold line 38, to fourth side panel 36. Blank 10 also includes a sixth side panel 44 (second end side panel), coupled across a side fold line 42, to fifth side panel 40. In one embodiment, the side panels have a substantially equal width W2 and a substantially equal length L2. Sixth side panel 44 includes a side joining tab 48 coupled across a joint fold line 46, from an edge opposed to fifth side panel 40. In one embodiment, side joining tab 48 has a width W3 and length L2.

In one embodiment, first side panel 24 includes an emboss area 126. Emboss area 126 is substantially rectangular in shape and is defined by a portion of top edge 16, first end edge 20, a portion of a bottom fold line 52, and has a second edge boundary parallel to first end edge 20 extending across first side panel 24 a width substantially equal to the width W3 of side joining tab 48. Emboss area 126 includes a cross-hatch pattern, e.g., a series of "X" shapes, impressed onto inner surface 12 to help adhesive penetration into the material fibers of blank 10 and facilitate coupling to side joining tab 48.

Blank 10 also includes a plurality of bottom flaps. A first bottom flap 50 extends from bottom edge 18 of first side panel 24 across a bottom fold line 52. A second bottom flap 60 extends from bottom edge 18 of second side panel 28 across a bottom fold line 62. A third bottom flap 68 extends from bottom edge 18 of third side panel 32 across a bottom fold line 70. A fourth bottom flap 74 extends from bottom edge 18 of fourth side panel 36 across a bottom fold line 76. A fifth bottom flap 96 extends from bottom edge 18 of fifth side panel 40 across a bottom fold line 98. A sixth bottom flap 106 extends from bottom edge 18 of sixth side panel 44 across a bottom fold line 108. The first, second, fourth, and fifth bottom flaps are minor bottom flaps, and the third and sixth bottom flaps are major bottom flaps.

In alternative embodiments, blank 10 and any portions thereof have any dimensions suitable for forming a bulk bin as described herein.

As shown in FIG. 1, first bottom flap 50 is substantially triangular in shape, including bottom fold line 52, a first free edge 54, and a second free edge 56, wherein first free edge 54 is longer than second free edge 56 but shorter than bottom fold line 52. Second free edge 56 extends from bottom edge 18 proximate to side fold line 26 forming an acute angle with bottom fold line 52. First bottom flap 50 includes a crush area 58 that is substantially triangular in shape, wherein crush area 58 is defined by a portion of first free edge 54 and a portion of second free edge 56 and has an upper boundary parallel to bottom fold line 52.

Second bottom flap 60 is substantially triangular in shape, including bottom fold line 62, joint fold line 84, and free edge 64, wherein free edge 64 is longer than joint fold line 84 but shorter than bottom fold line 62. Joint fold line 84 extends from bottom edge 18 proximate to side fold line 26 forming an acute angle with bottom fold line 62. Second bottom flap 60 also includes a crush area 66 that is substantially triangular in shape, wherein crush area 66 is defined by a portion of free edge 64 and a portion of joint fold line 84 and has an upper boundary parallel to bottom fold line 62. Second bottom flap 60 is coupled to a first minor joining tab 82 across joint fold line 84. First minor joining tab 82 is substantially triangular in shape and is defined by joint fold line 84, a first free edge 86, and a second free edge 87, where first free edge 86 is substantially collinear with side fold line 26. First minor joining tab 82 includes a crush area that is substantially the entire area of first minor joining tab 82.

Fourth bottom flap 74 is substantially triangular in shape, including bottom fold line 76, joint fold line 90, and free edge 78, wherein free edge 78 is longer than joint fold line 90 but shorter than bottom fold line 76. Joint fold line 90 extends from bottom edge 18 proximate to side fold line 38 forming an acute angle with bottom fold line 76. Fourth bottom flap 74 also includes a crush area 80 that is substantially triangular in shape wherein crush area 80 is defined by a portion of free edge 78 and a portion of joint fold line 90 and has an upper boundary parallel to bottom fold line 76. Fourth bottom flap 74 is coupled to a second minor joining tab 88 across joint fold line 90. Second minor joining tab 88 is substantially triangular in shape and is defined by joint fold line 90, a first free edge 92, and a second free edge 94, where first free edge 92 is substantially collinear with side fold line 38. Second minor joining tab 88 includes a crush area that is substantially the entire area of second minor joining tab 88.

Fifth bottom flap 96 is substantially triangular in shape, including bottom fold line 98, a first free edge 100, and a second free edge 102, wherein first free edge 100 is longer than second free edge 102 but shorter than bottom fold line 98. Second free edge 102 extends from bottom edge 18 proximate to side fold line 38 forming an acute angle with bottom fold line 98. Fifth bottom flap 96 also includes a crush area 104 that is substantially triangular in shape, wherein crush area 104 is defined by a portion of first free edge 100 and a portion of second free edge 102 and has an upper boundary parallel to bottom fold line 98.

Third bottom flap 68 is polygonal in shape. In the example embodiment, blank 10 forms a six-sided container. Accordingly, third bottom flap 68, which forms part of the bottom wall of the six-sided container, has five side edges. Third bottom flap 68 includes at least bottom fold line 70, a first free edge 122, a second free edge 120, and a bottom free edge 72. Bottom free edge 72 is parallel to bottom fold line 70 and opposed to third side panel 32. First free edge 122 and second free edge 120 are parallel to one another and substantially perpendicular to bottom fold line 70. First free edge 122 is spaced from second free edge 120 a distance W4, wherein W4 is greater than the length of bottom fold line 70. Third bottom flap 68 includes a substantially rectangular major joining tab 114 coupled across joint fold line 116 a length L3, from an edge opposed to third side panel 32. Major joining tab 114 includes a crush area that is substantially the entire area of major joining tab 114.

Sixth bottom flap 106 is polygonal in shape. In the example embodiment, blank 10 forms a six-sided container. Accordingly, sixth bottom flap 106, which forms part of the bottom wall of the six-sided container, has five side edges. Sixth bottom flap 106 includes at least bottom fold line 108, a first free edge 112, a second free edge 118, and a bottom free edge 110. Bottom free edge 110 is parallel to bottom fold line 108 and opposed to sixth side panel 44. First free edge 112 and second free edge 118 are parallel to one another and substantially perpendicular to bottom fold line 108. First free edge 112 is spaced from second free edge 118 a distance W5, wherein W5 is greater than the length of bottom fold line 108. First free edge 112 is substantially collinear with second end edge 22 to reduce the amount of material waste when constructing blank 10. Sixth bottom flap 106 includes a substantially rectangular notch 124 along bottom free edge 110, wherein notch 124 is configured to interface with major joining tab 114 and is a width W6 and length L4.

Figure 2:
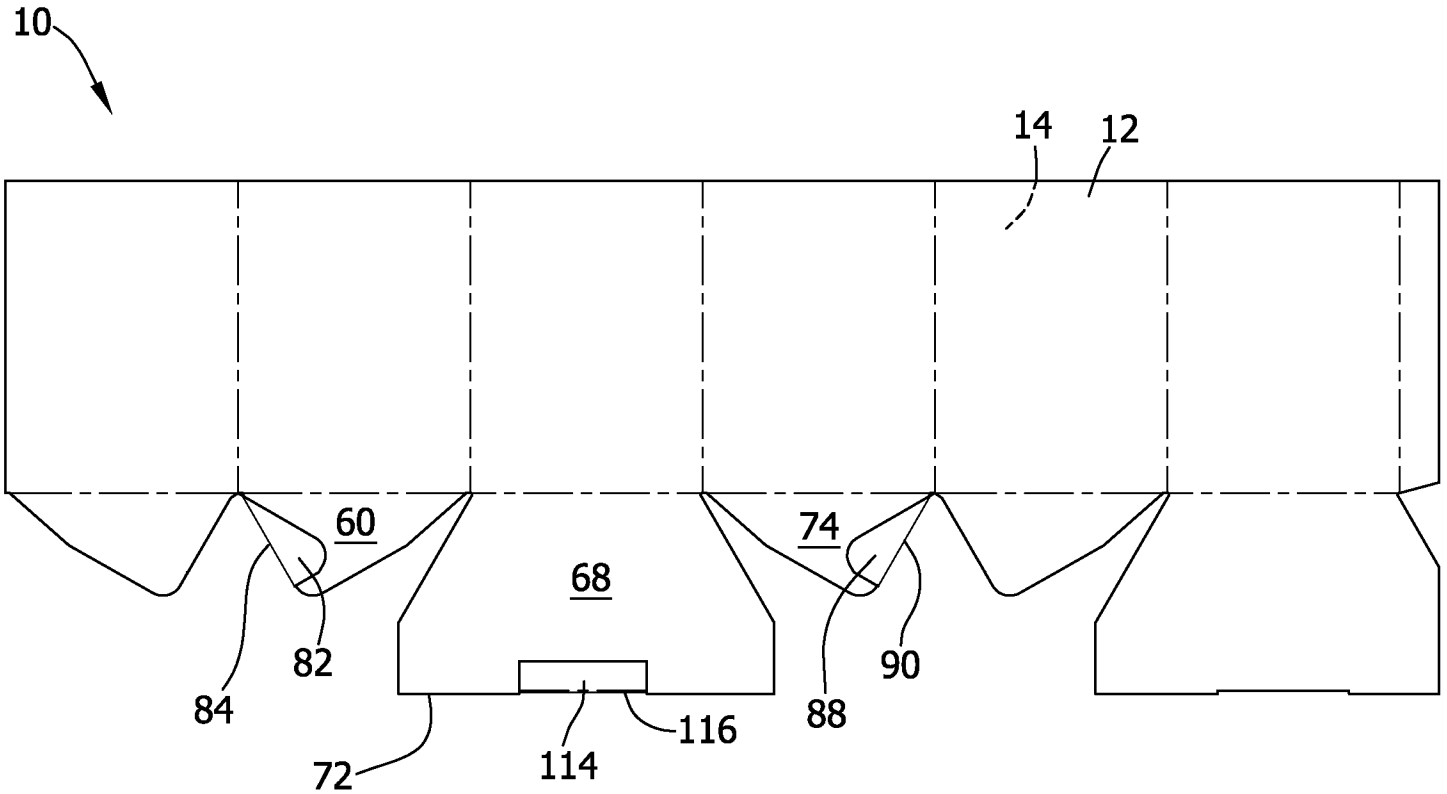
FIG. 2 is a top plan view of the blank of sheet material in one step of assembly.

FIG. 2 is a top plan view of blank of sheet material 10 in one step of assembly. First minor joining tab 82 is folded approximately 180 degrees along joint fold line 84 so interior surface 12 of first minor joining tab 82 is in a face-to-face relationship with interior surface 12 of second bottom flap 60. Further, second minor joining tab 88 is folded approximately 180 degrees along joint fold line 90 so interior surface 12 of second minor joining tab 88 is in a face-to-face relationship with interior surface 12 of fourth bottom flap 74. Also, major joining tab 114 is folded approximately 180 degrees along joint fold line 116 so interior surface 12 of major joining tab 114 is in a face-to-face relationship with interior surface 12 of third bottom flap 68.

Figure 3:
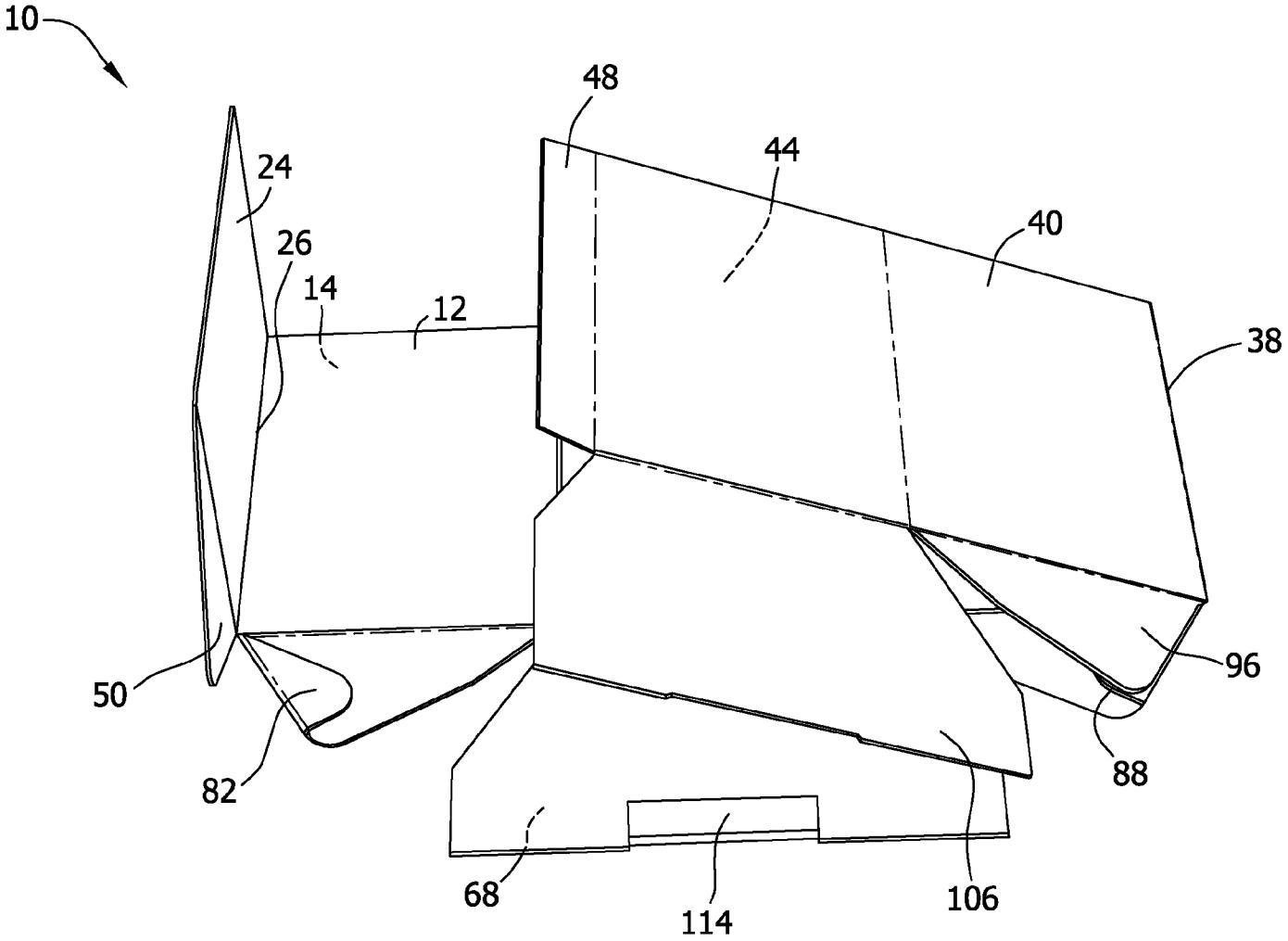
FIG. 3 is a perspective view of the blank of sheet material in another step of assembly.

FIG. 3 is a perspective view of the blank of sheet material 10 in another step of assembly. An adhesive is applied to substantially the entire exterior surface 14 of first minor joining tab 82, second minor joining tab 88, and major joining tab 114. In one embodiment, blank 10 is rotated upon itself by folding an end portion including fifth side panel 40, sixth side panel 44, and side joining tab 48, approximately 180 degrees along side fold line 38 such that second minor joining tab 88 is adhesively coupled to at least a portion of interior surface 12 of fifth bottom flap 96, and major joining tab 114 is adhesively coupled to at least a portion of interior surface 12 of sixth bottom flap 106. An adhesive is applied to substantially the entire exterior surface 14 of side joining tab 48. An end portion of blank 10 including first side panel 24 is rotated approximately 180 degrees along side fold line 26 such that first minor joining tab 82 is adhesively coupled to at least a portion of the interior surface 12 of first bottom flap 50, and side joining tab 48 is adhesively coupled to at least a portion of interior surface 12 of first side panel 24, substantially coincident with emboss area 126 (shown in FIG. 1).

In another embodiment, an adhesive is applied to substantially the entire interior surface 12 of side joining tab 48 and side joining tab 48 is adhesively coupled to at least a portion of exterior surface 14 of first side panel 24, substantially coincident with emboss area 126 (shown in FIG. 1).

In one embodiment, an adhesive of sufficient strength for adhering the material of blank 10 in a face-to-face relationship is used. However, any other chemical or mechanical fastener is acceptable for this coupling as described above.

Figure 4:
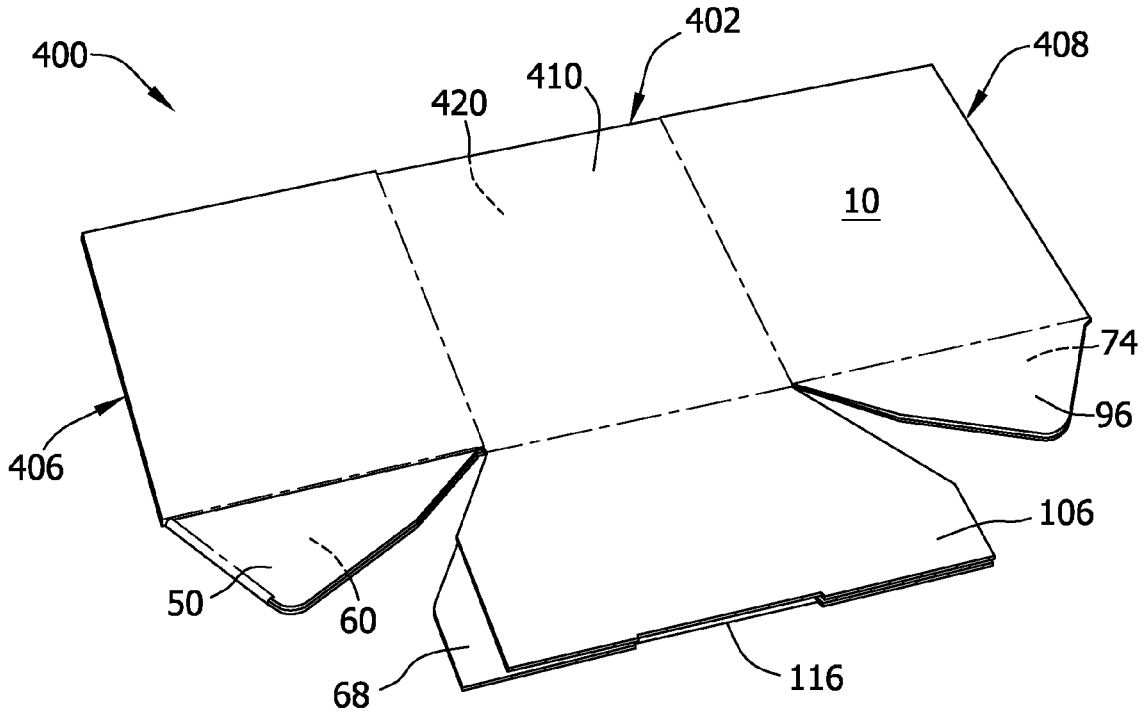
FIG. 4 is a perspective view of the blank of sheet material in another step of assembly.

FIG. 4 is a perspective view of the blank of sheet material 10 in another step of assembly. Blank 10 is in a collapsed configuration, rotated onto itself, and coupled thereto forming a knocked-down flat container 400. Knocked-down flat container 400 requires a great deal less space to store, and less space to transport, than fully erected container 600 (shown in FIG. 6). However, because joining tabs 82, 88, 114 are rotated substantially 180 degrees about their respective fold lines and coupled to particular bottom flaps as discussed above, these areas necessarily have a greater material thickness than the area associated with the side panels of the container. Crush areas 58, 66, 80, 104, and the crush areas of joining tabs 82, 88, 114, therefore, are included to reduce the thickness of knocked-down flat container 400 in these areas and facilitate transport and storage of knocked-down flat container 400.

Before use, however, knocked-down flat container 400 must be erected into a usable container. This erection process can be performed by a single person, in part, because the container is configured with an automatically-erecting bottom wall that is formed when the side panels are moved out of planar communication with each other. As discussed in more detail below, when the side panels are moved out of planar communication with one another, the minor bottom flaps 50, 60, 74, 96 automatically rotate upwardly to a substantially perpendicular relationship with the container side panels to form a portion of the bottom wall of the container. Simultaneously, the major bottom flaps 68, 106 automatically rotate upwardly to a substantially perpendicular relationship with the container side panels to support minor bottom flaps 50, 60, 74, 96 and form the remaining portion of the bottom wall of the container.

In one embodiment, to form container 600 from knocked-down flat container 400, first side panel 410 is moved out of planar communication with fourth side panel 420. For example, top edge 402 of first side panel 410 is pulled away from top edge 402 of fourth side panel 420; or fold line 406 is pushed toward fold line 408, forcing first side panel 410 apart from fourth side panel 420.

Moving first side panel 410 out of planar communication with fourth side panel 420 removes first bottom flap 50 from planar communication with second bottom flap 60. First minor joining tab 82 (referenced in FIGS. 1-3, 5), however, remains coupled to first bottom flap 50. First bottom flap 50 and second bottom flap 60 rotate about bottom fold lines 52 and 62 respectively, into a substantially perpendicular relationship to first side panel 24 and second side panel 28 respectively to form a portion of the bottom wall of the container. Moving first side panel 410 out of planar communication with fourth side panel 420 also causes third bottom flap 68 and sixth bottom flap 106 to rotate about joint fold line 116 removing third bottom flap 68 from planar communication with sixth bottom flap 106. Major joining tab 114 (referenced in FIGS. 1-3, 5), however, remains coupled to sixth bottom flap 106. Third bottom flap 68 and sixth bottom flap 106 rotate about bottom fold lines 70 and 108 respectively into a substantially perpendicular relationship to third side panel 32 and sixth side panel 44 respectively to form a portion of the bottom wall of the container. When fully erected, at least a portion of interior surface 12 of third bottom flap 68 and sixth bottom flap 106 are in communication with at least a portion of exterior surface 14 of minor bottom flaps 50 and 60 as illustrated with reference to FIG. 5.

Concurrently, moving first side panel 410 out of planar communication with fourth side panel 420 also removes fourth bottom flap 74 from planar communication with fifth bottom flap 96. Second minor joining tab 88 (referenced in FIGS. 1-3, 5), however, remains coupled to fifth bottom flap 96. Fourth bottom flap 74 and fifth bottom flap 96 rotate about bottom fold lines 76 and 98 respectively, into a substantially perpendicular relationship to fourth side panel 36 and fifth side panel 40 respectively. When fully erected, at least a portion of interior surface 12 of third bottom flap 68 and sixth bottom flap 106 are in communication with at least a portion of exterior surface 14 of minor bottom flaps 74 and 96 as illustrated with reference to FIG. 5.

This erection process can be performed by a single person and without the use of special equipment, thereby reducing employment expenses. Additionally, the container can be erected in an upright position without the need to invert the container to manually configure and interconnect the bottom flaps, thereby reducing the chances of contaminating the top edge of the container. Furthermore, the time necessary to erect an assembled container from a knocked-down flat can be reduced, thereby increasing productivity. These benefits are achieved while providing a structurally stable container.

Figure 5:
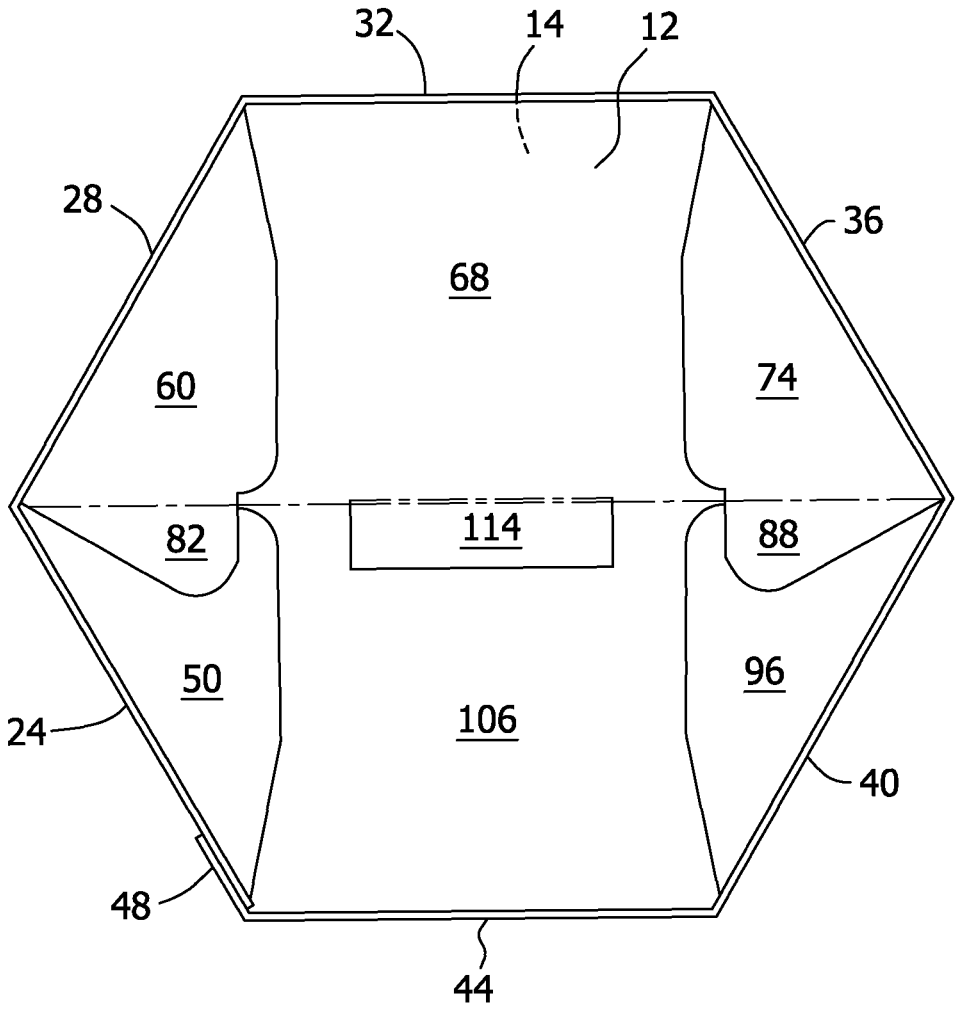
FIG. 5 is a top plan view of the erected container illustrating the overlaying flaps within the container body.

FIG. 5 is a top plan view of erected container 600 (shown in FIG. 6) illustrating the overlaying flaps within the cavity of the container. When fully erected, at least a portion of interior surface 12 of third bottom flap 68 and sixth bottom flap 106 are in communication with at least a portion of exterior surface 14 of first bottom flap 50 and second bottom flap 60. First minor joining tab 82 is coupled to at least a portion of interior surface 12 of first bottom flap 50. Also, at least a portion of interior surface 12 of third bottom flap 68 and sixth bottom flap 106 are in communication with at least a portion of exterior surface 14 of fourth bottom flap 74 and fifth bottom flap 96. Second minor joining tab 88 is coupled to at least a portion of interior surface 12 of fifth bottom flap 96. Additionally, major joining tab 114 is coupled to at least a portion of interior surface 12 of sixth bottom flap 106.

When container 600 is fully erected, third bottom flap 68 and sixth bottom flap 106 form a substantially flat bottom surface of container 600, configured to fit on a standard sized pallet, and support minor bottom flaps 50, 60, 74, and 96. Minor bottom flaps 50, 60, 74, and 96 are configured to expose a large surface area to the inside volume of container. Furthermore, when the container is filled with product, minor bottom flaps 50, 60, 74, and 96 are at least partially frictionally held in place by the weight of the product, thereby facilitating reducing outward bulge of the container 600 side panels 24, 28, 32, 36, 40, and 44.

Figure 6:
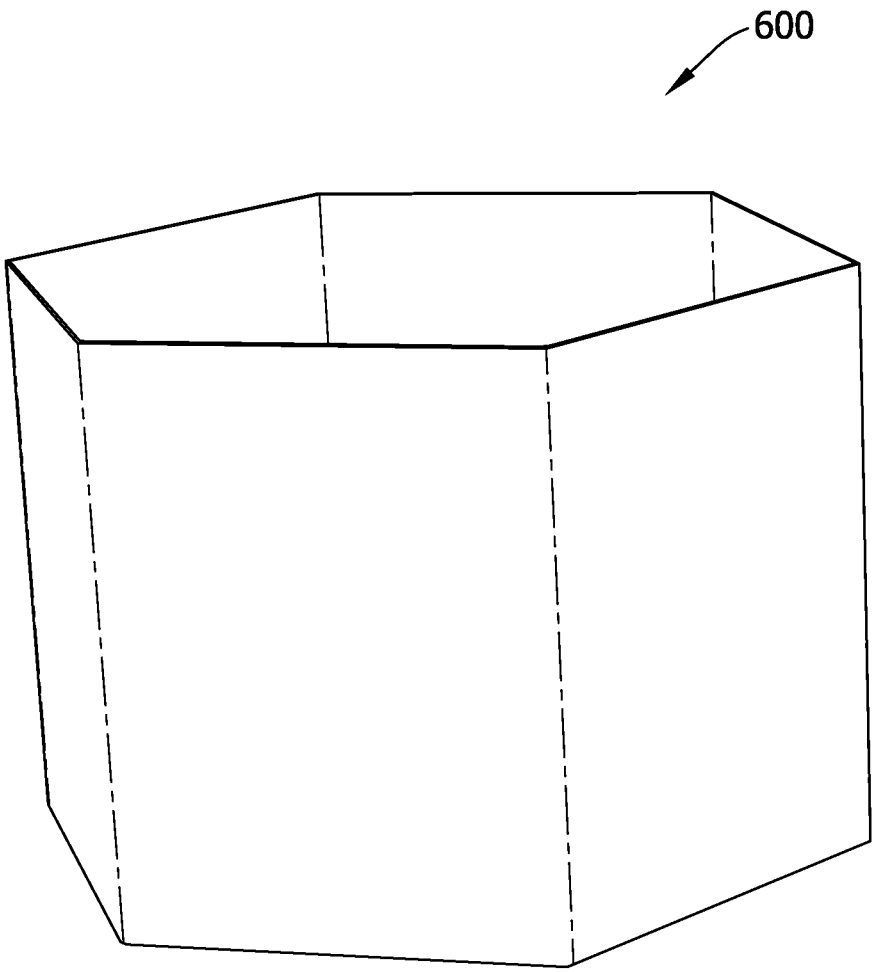
FIG. 6 is a perspective view of the erected container.

FIG. 6 is a perspective view of the erected container. When erected, container 600 is filled with a product to be stored or transported. In one embodiment, container 600 may include a liner made of plastic or a similar material for providing a moisture-resistant barrier. The bottom wall of container 600 is configured from the plurality of major and minor bottom flaps, as illustrated with reference to FIG. 5, and is configured to not puncture or cut such liner that may be placed within container 600.

Figure 7:
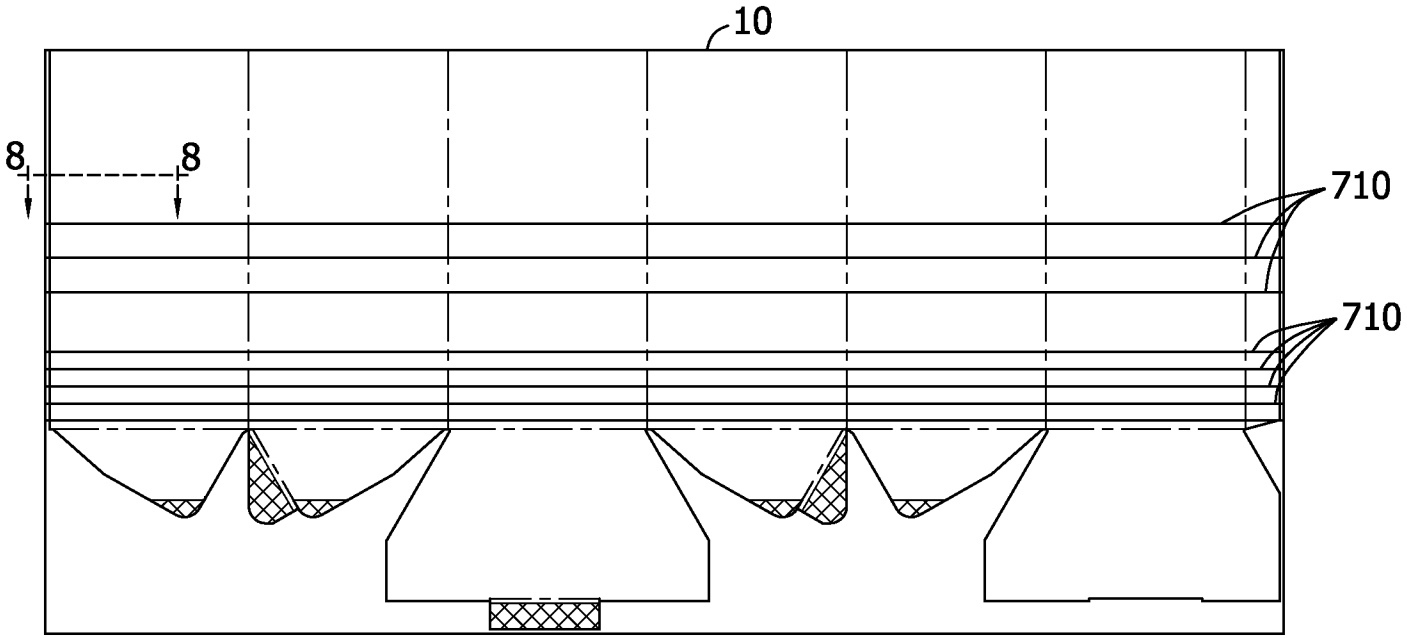
FIG. 7 is a plan view of the blank of sheet material including reinforcing strap locations.

FIG. 7 is a plan view of the blank of sheet material 10 including reinforcing strap locations. When container 600 is filled with a product, the product applies pressure to the side panels of container 600. One method of reinforcing container 600 to prevent outward bowing of the side panels is to wrap one or more reinforcing straps 710 around container 600. Another method of reinforcing container 600 to prevent outward bowing of the side panels is to include one or more reinforcing straps 710 within the blank of sheet material 10. Another method of reinforcing container 600 to prevent outward bowing of the side panels is to include one or more reinforcing straps 710 within the blank of sheet material 10, and to wrap one or more reinforcing straps 710 around container 600.

In one embodiment, the reinforcing straps 710 are strips of polypropylene plastic or of a polyester-type material that is thermally fused or welded together at their ends to secure the straps in sufficient tension outside the container side panels for frictionally holding the straps to the container 600. Girth support is provided when the container is in an erected position by the horizontally placed reinforcing straps 710 at longitudinally spaced locations along the side panels. In one embodiment, the plastic straps include prestretched polypropylene straps, prestretched to provide a low elongation factor and preferably to reduce a typical stretching by approximately fifty percent.

The number of reinforcing straps on blank 10 may vary. Additionally, the locations of the reinforcing straps on blank 10 may vary in distance between each reinforcing strap or can be the same distance between each reinforcing strap. In one specific example as illustrated with reference to FIG. 7, numbering the reinforcing straps #1, #2, #3, #4, #5, #6, #7, and #8 (where #1 is the reinforcing strap farthest from the bottom of the container and #8 is the reinforcing strap closest to the bottom of the container), the distance between reinforcing straps #1 and #2, and between reinforcing straps #2 and #3 is distance X, while the distance between reinforcing straps #3 and #4 is distance Z, and the distance between reinforcing straps #4 and #5, between reinforcing straps #5 and #6, between reinforcing straps #6 and #7, and between reinforcing straps #7 and #8 is distance Y, wherein distance X is greater than distance Y and distance Z is greater than distance X in order to provide support to the container. In another embodiment, the distance between each reinforcing strap going from strap #1 to strap #8 becomes increasingly smaller.

Figure 8:
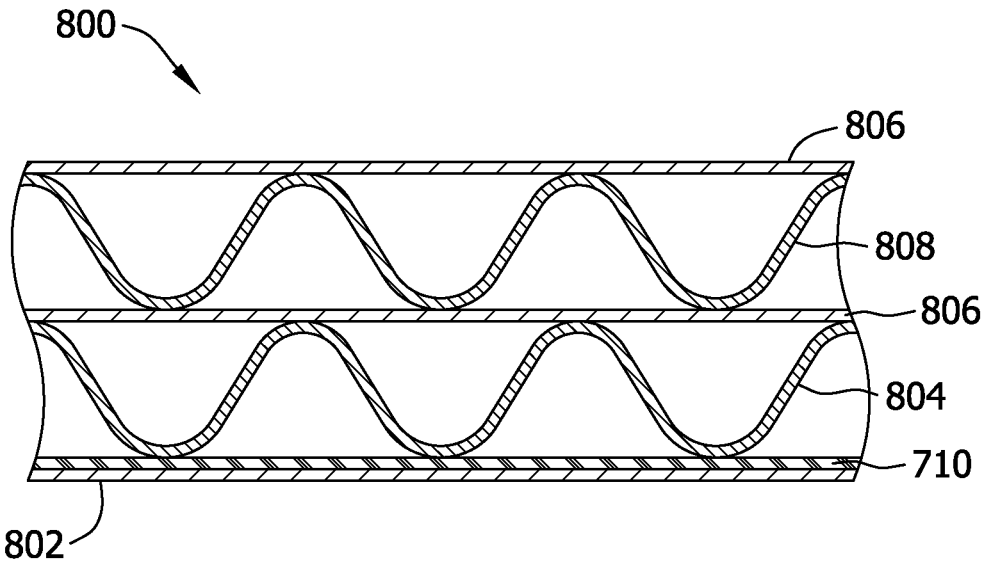
FIG. 8 is a partial cross sectional view of double wall corrugated paperboard illustrating a reinforcing strap location.

FIG. 8 is a partial cross sectional view of a double wall corrugated paperboard illustrating a reinforcing strap location. In one embodiment, blank 10 is fabricated from double wall corrugated paperboard with reinforcing straps 710 adhesively bonded within the double wall corrugated paperboard. Double wall paperboard 800 comprises three liners and two mediums: outside liner 802, and inside liners 806; and outside medium 804, and inside medium 808. The reinforcing straps 710 are adhesively coupled to outside liner 802 and outside medium 804. The side panels of the container 600 are formed with the corrugations within the outside medium 804 and inside medium 808 positioned perpendicular to reinforcing straps 710. In one embodiment, the reinforcing straps 710 are reinforcing tape composed of continuous strands of high tensile strength filaments, coated and impregnated with an adhesive.

As used herein, an element or step recited in the singular and preceded with the word "a" or "an" should be understood as not excluding plural said elements or steps, unless such exclusion is explicitly recited. Furthermore, references to "one embodiment" of the present invention are not intended to be interpreted as excluding the existence of additional embodiments that also incorporate the recited features.

The above-described apparatus and methods facilitate providing a bulk bin assembly capable of being erected and collapsed by a single person. Further, the above-described apparatus and methods provide a bulk bin assembly that is reinforced to facilitate providing strength against a weight of materials placed therein.

Although the apparatus and methods described herein are described in the context of a reinforced bulk bin assembly and method for making the same, it is understood that the apparatus and methods are not limited to reinforced bulk bin assemblies.

While the invention has been described in terms of various specific embodiments, those skilled in the art will recognize that the invention can be practiced with modification within the spirit and scope of the claims.

What is claimed is:

1. A container having an automatically-erecting bottom wall that is selectively moveable between a substantially flat position and a fully erect position, said container formed from a single blank of sheet material, said container comprising:

a plurality of side panels for forming side walls of the container, the side panels comprising at least a first, second, and third side panel, and a side joining tab, said plurality of side panels at least partially defining a cavity of the container; and a plurality of bottom flaps for forming an automatically-erecting bottom wall, the plurality of bottom flaps comprising at least a first, second, and third bottom flap, each bottom flap extending from a bottom edge of a respective side panel of the plurality of side panels, each bottom flap including an exterior surface and an interior surface relative to the cavity of the container, wherein the first and second bottom flaps are minor bottom flaps, and the third bottom flap is a major bottom flap, wherein the second bottom flap includes a first minor joining tab for coupling the second bottom flap to the first bottom flap, wherein an exterior surface of the first minor joining tab couples to the interior surface of the first bottom flap such that the exterior surface of the first and second bottom flaps are in a face-to-face relationship with the interior surface of at least one major bottom flap when the container is in the fully erect position, and wherein the third bottom flap includes a major joining tab for coupling to a second major bottom flap.

2. The container according to claim 1 further comprising a fourth bottom flap extending from the bottom edge of a fourth side panel, a fifth bottom flap extending from the bottom edge of a fifth side panel, and a sixth bottom flap extending from the bottom edge of a sixth side panel, wherein the fourth and fifth bottom flaps are minor bottom flaps, and the sixth bottom flap is another major bottom flap.

3. The container according to claim 2, wherein the fourth bottom flap includes a second minor joining tab for coupling the fourth bottom flap to the fifth bottom flap, and wherein the container is assembled by placing the container in a substantially flat position.

4. The container according to claim 3, wherein the side joining tab is coupled to the first side panel, the major joining tab is coupled to the sixth bottom flap, the first minor joining tab is coupled to the first bottom flap, and the second minor joining tab is coupled to the fifth bottom flap such that the container is configured to be selectively moved between a substantially flat position and a fully erect position.

5. The container according to claim 2, wherein the minor bottom flaps are configured to automatically rotate upwardly toward the cavity to form at least a portion of the automatically-erecting bottom wall.

6. The container according to claim 5, wherein the major bottom flaps are configured to automatically rotate upwardly toward the cavity to form at least a portion of the automatically-erecting bottom wall, and wherein the major bottom flaps are configured to support the minor bottom flaps in a face-to-face relationship.

7. The container according to claim 1 further comprising a plurality of continuous reinforcing straps extending around an outer perimeter of the container, wherein each reinforcing strap is positioned in a predetermined location between a top edge and the bottom edge of the plurality of side panels.

8. The container according to claim 1, wherein the single blank of sheet material is fabricated from corrugated paperboard comprising:

an outer paperboard liner including an outer and inner surface;

a plurality of continuous reinforcing straps extending around a perimeter of the container, each strap including an outer and inner surface, wherein the outer surface of each strap is coupled to the inner surface of said outer paperboard liner;

an inner paperboard liner spaced a distance from the outer paperboard liner; and a paperboard medium extending between the inner paperboard liner and at least one of the outer paperboard liner and the plurality of reinforcing straps.

9. The container according to claim 8, wherein each strap of the plurality of continuous reinforcing straps is positioned at a predetermined location between a top edge and the bottom edge of the plurality of side panels.

10. The container according to claim 1, wherein the minor bottom flaps and the major bottom flaps are configured to automatically rotate upwardly toward the cavity to form at least a portion of the bottom wall when the container is moved from the substantially flat position to the fully erect position.

11. A container having an automatically-erecting bottom wall that is selectively moveable between a substantially flat position and a fully erect position, said container formed from a single blank of sheet material, said container comprising:

a plurality of side panels for forming side walls of the container, the plurality of side panels comprising a first side panel coupled across a fold line to a second side panel, a third side panel coupled across a fold line to the second side panel, a fourth side panel coupled across a fold line to the third side panel, a fifth side panel coupled across a fold line to the fourth side panel, and a sixth side panel coupled across a fold line to the fifth side panel, wherein the sixth side panel has a side joining tab extending from an edge opposed to the fifth side panel, wherein the side joining tab couples to the first side panel; and a plurality of bottom flaps for forming an automatically-erecting bottom wall when the container is moved from the substantially flat position to the fully erect position, the plurality of bottom flaps comprising first, second, third, fourth, fifth, and sixth bottom flaps, each bottom flap extending from a bottom edge of a respective side panel of the plurality of side panels, each bottom flap including an exterior surface and an interior surface relative to the cavity of the container, wherein the third and sixth bottom flaps are major bottom flaps, and the first, second, fourth and fifth bottom flaps are minor bottom flaps, wherein the second bottom flap has a first minor joining tab extending from a first joint fold line, the first minor joining tab rotatable about the first joint fold line such that an exterior surface of the first minor joining tab couples to the interior surface of the first bottom flap such that the exterior surface of the first, second, fourth and fifth bottom flaps are in a face-to-face relationship with the interior surface of at least one of the major bottom flaps when the container is in the fully erect position, wherein the fourth bottom flap has a second minor joining tab extending from a second joint fold line, the second minor joining tab rotatably coupled to the fifth bottom flap, and wherein the third bottom flap has a major joining tab extending from a third joint fold line, the major joining tab rotatably coupled to the sixth bottom flap such that when the container is moved from the substantially flat position to the fully erect position the plurality of bottom flaps automatically form the bottom wall.

12. The container according to claim 11, wherein the third and sixth bottom flaps are opposed to each other and arranged such that the container is configured to be selectively moved between the substantially flat position and the fully erect position.

13. The container according to claim 11, wherein the single blank of sheet material is fabricated from corrugated paperboard comprising:

an outer paperboard liner including an outer and inner surface;

a plurality of continuous reinforcing straps extending around a perimeter of the container, each strap including an outer and inner surface, wherein the outer surface of each strap is coupled to the inner surface of said outer paperboard liner;

an inner paperboard liner spaced a distance from the outer paperboard liner; and a paperboard medium extending between the inner paperboard liner and at least one of the outer paperboard liner and the plurality of reinforcing straps.

14. The container according to claim 11 further comprising a plurality of continuous reinforcing straps extending around an outer perimeter of the container, wherein each reinforcing strap is positioned in a predetermined location between a top edge and the bottom edge of the plurality of side panels when the container is in the fully erected position and in the substantially flat position.

15. A method for constructing a container, the method comprising:

providing a single blank of sheet material including:

a plurality of side panels including at least a first, second, and third side panel, and a side joining tab, said plurality of side panels for at least partially defining a cavity of the container, and a plurality of bottom flaps including at least a first, second, and third bottom flap, each bottom flap extending from a bottom edge of a respective side panel of the plurality of side panels, wherein the first and second bottom flaps are minor bottom flaps, and the third bottom flap is a major bottom flap, wherein the second bottom flap has a first minor joining tab extending from a first joint fold line, wherein the third bottom flap has a major joining tab extending from a second joint fold line, each bottom flap including an exterior surface and an interior surface relative to the cavity of the container;

folding the first minor joining tab about the first joint fold line such that an interior surface of the first minor joining tab is in substantially face-to-face contact with an interior surface of the second bottom flap;

folding the major joining tab about the second joint fold line such that an interior surface of the major joining tab is in substantially face-to-face contact with an interior surface of the third bottom flap;

folding the first and second bottom flaps over each other such that an exterior surface of the first minor joining tab couples to an interior surface of the first bottom flap, and such that the exterior surface of the first and second bottom flaps are in substantially face-to-face contact with the interior surface of at least one major bottom flap when the container is constructed; and coupling the major joining tab to another major bottom flap.

16. The method according to claim 15, further comprising moving the first side panel out of planar communication with the second side panel, wherein the minor bottom flaps and the major bottom flaps automatically rotate upwardly toward the cavity to form at least a portion of the bottom wall when the container is moved from a substantially flat position to the fully erect position.

17. The method according to claim 15, further comprising:

providing the single blank of sheet material further including a fourth bottom flap extending from the bottom edge of a fourth side panel, a fifth bottom flap extending from the bottom edge of a fifth side panel, a sixth bottom flap extending from the bottom edge of a sixth side panel, and having the side joining tab extending from an edge of the sixth side panel opposed to the fifth side panel, wherein the fourth and fifth bottom flaps are minor bottom flaps, and the sixth bottom flap is a major bottom flap, wherein the fourth bottom flap has a second minor joining tab extending from a third joint fold line;

folding the second minor joining tab about the third joint fold line such that an interior surface of the second minor joining tab is in substantially face-to-face contact with an interior surface of the fourth bottom flap;

coupling the second minor joining tab to the fifth bottom flap; and coupling the side joining tab to the first side panel.

18. The method according to claim 17, further comprising moving the first side panel out of planar communication with the second side panel, wherein the minor bottom flaps and the major bottom flaps automatically rotate upwardly toward the cavity to form at least a portion of the bottom wall when the container is moved from a substantially flat position to the fully erect position.

19. The method according to claim 15 further comprising positioning a plurality of continuous reinforcing straps extending around an outer perimeter of the container, wherein each reinforcing strap is positioned in a predetermined location between a top edge and the bottom edge of the plurality of side panels.

20. The method according to claim 15, further comprising:

fabricating the blank of sheet material from corrugated paperboard including an outer paperboard liner including an outer and inner surface, an inner paperboard liner including an outer and inner surface, and a paperboard medium including an outer and inner surface, including;

positioning a plurality of continuous reinforcing straps extending the width of the single blank of sheet material in predetermined locations between a top edge and a bottom edge of the blank of sheet material, each strap including an outer and inner surface;

coupling the outer surface of each of the plurality of reinforcing straps to the inner surface of the outer paperboard liner;

coupling the outer surface of the paperboard medium to the inner surface of each of the plurality of reinforcing straps; and coupling the outer surface of the inner paperboard liner to the inner surface of the paperboard medium.

* * * * *